US009830861B2

(12) United States Patent
Park

(10) Patent No.: US 9,830,861 B2
(45) Date of Patent: Nov. 28, 2017

(54) DISPLAY DEVICE

(71) Applicant: LG Display Co., Ltd., Seoul (KR)
(72) Inventor: Joon-Min Park, Seoul (KR)
(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 14/958,680
(22) Filed: Dec. 3, 2015

(65) Prior Publication Data

US 2016/0189617 A1 Jun. 30, 2016

(30) Foreign Application Priority Data

Dec. 30, 2014 (KR) ..... 10-2014-0194305

(51) Int. Cl.

| | |
|---|---|
| ***G09G 1/00*** | (2006.01) |
| ***G09G 5/10*** | (2006.01) |
| ***G09G 3/3258*** | (2016.01) |
| ***G09G 3/3233*** | (2016.01) |

(52) U.S. Cl.
CPC ..... *G09G 3/3258* (2013.01); *G09G 3/3233* (2013.01); *G09G 5/10* (2013.01); *G09G 2300/0443* (2013.01); *G09G 2300/0452* (2013.01); *G09G 2310/0232* (2013.01); *G09G 2310/0248* (2013.01); *G09G 2310/061* (2013.01); *G09G 2310/063* (2013.01); *G09G 2310/08* (2013.01); *G09G 2320/0233* (2013.01)

(58) Field of Classification Search
CPC ..... G09G 3/3258; G09G 5/10; G09G 2300/0443; G09G 2300/0452; G09G 2310/08; G09G 2310/063; G09G 2320/0233; G09G 3/3233; G09G 2310/0232; G09G 2310/0248; G09G 2310/061
See application file for complete search history.

(56) References Cited

U.S. PATENT DOCUMENTS

| | | | | |
|---|---|---|---|---|
| 2013/0099832 | A1 | 4/2013 | Kimura | |
| 2014/0176516 | A1 | 6/2014 | Kim et al. | |
| 2014/0354625 | A1 | 12/2014 | Shin | |
| 2015/0054862 | A1* | 2/2015 | Kaplan | G09G 3/2022 345/691 |

FOREIGN PATENT DOCUMENTS

EP 1566793 A1 8/2005

* cited by examiner

*Primary Examiner* — Charles Hicks
(74) *Attorney, Agent, or Firm* — Birch, Stewart, Kolasch & Birch, LLP

(57) ABSTRACT

A display device can include a display panel, in which a subpixel including a transistor where data lines and gate lines intersect, is disposed; a gate driving unit that sequentially outputs a gate signal to the gate lines; a data driving unit that outputs a data voltage to the data lines according to the gate signal provided to each gate line, and outputs to the data lines during a blank time before a specific frame, data voltages having an output waveform that is identical to data voltages of at least one gate line of the specific frame; and a timing controller that controls the gate driving unit and the data driving unit, and performs a pixel compensation which changes data provided to each subpixel.

19 Claims, 17 Drawing Sheets

DISPLAY DEVICE

CROSS-REFERENCE TO RELATED APPLICATION

This application claims priority from and the benefit under 35 U.S.C. §119(a) of Korean Patent Application No. 10-2014-0194305, filed in the Republic of Korea on Dec. 30, 2014, which is hereby incorporated by reference for all purposes as if fully set forth herein.

BACKGROUND OF THE INVENTION

1. Field of the Invention

The present invention relates to a display device displaying an image.

2. Description of the Prior Background Art

As the information society develops, display devices for displaying an image are being increasingly required in various forms, and in recent years, various display devices such as Liquid Crystal Displays (LCDs), Plasma Display Panels (PDPs), and Organic Light Emitting Diode (OLED) display devices have been utilized.

The display device includes a display panel, a data driving unit and a gate driving unit. The display panel includes data lines and gate lines, and pixels are defined at each point where the data lines and the gate lines intersect. The data driving unit provides data signals to the data lines. The gate driving unit provides scan signals to the gate lines.

A transistor is disposed in each subpixel defined in the display panel. Characteristic values of the transistors in each subpixel may change, or the characteristic values of the transistors in each subpixel may deviate. Also, when the display device is the OLED display device, a deviation of a degradation of an OLED in each subpixel may occur. Such a phenomenon may generate a luminance non-uniformity between each subpixel and may degrade display quality.

Thus, in order to resolve the luminance non-uniformity between the subpixels, a pixel compensation technique for compensating a characteristic value change or a deviation of an element (e.g., a thin film transistor and an OLED) in a circuit is proposed.

The pixel compensation technique is a technique which senses a specific node of a circuit in the subpixel, changes data provided to each subpixel using a result of the sensing, and thus prevents or reduces the luminance non-uniformity of the subpixels.

SUMMARY OF THE INVENTION

An aspect of the present invention is to provide a technique which provides a pixel compensation function, and prevents a dark or brightness defect of a first gate line of a specific frame.

In accordance with an aspect of the present invention, a display device comprises: a display panel, in which a subpixel including a transistor in every point where data lines and gate lines intersect, is disposed; a gate driving unit that sequentially provides a gate signal to the gate lines; a data driving unit that provides a data voltage to the data lines according to the gate signal provided to each gate line, and outputs, to the data lines, the data voltages of which an output waveform is identical to that of data voltages of at least one gate line during a blank time before a specific frame; and a timing controller that controls the gate driving unit and the data driving unit, and performs a pixel compensation which changes data provided to each subpixel.

In accordance with another aspect of the present invention, a display device comprises: a display panel, in which a subpixel including a transistor in every point where data lines and gate lines intersect, is disposed; a gate driving unit that sequentially provides a gate signal to the gate lines; a data driving unit that provides a data voltage to the data lines according to the gate signal provided to each gate line, and outputs, to the data lines, the data voltages of a predetermined level during a blank time previous to a specific frame; and a timing controller that controls the gate driving unit and the data driving unit, and performs a pixel compensation which changes data provided to each subpixel.

As described above, according to an embodiment of the present invention, a pixel compensation function may be provided, and a dark or brightness defect of a first gate line of a specific display frame may be prevented.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EMBODIMENTS

Figure 1:
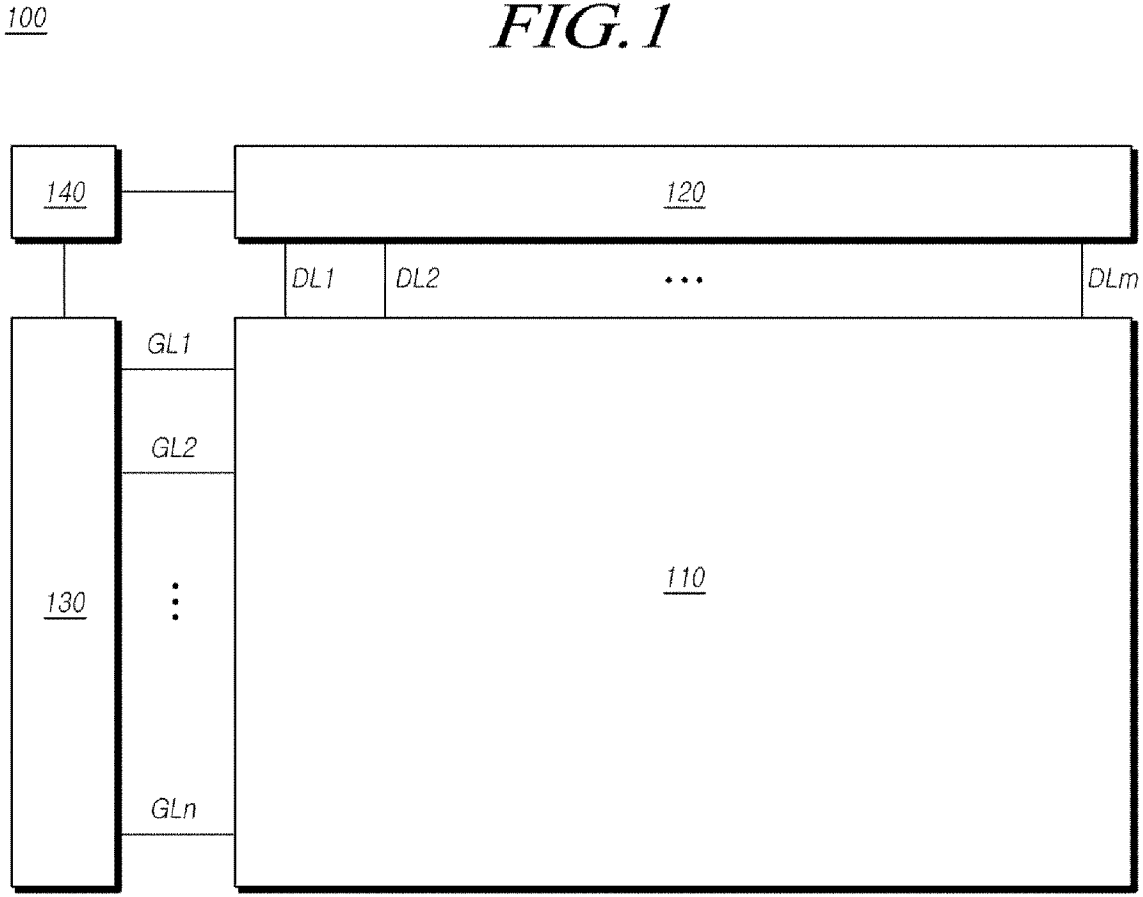
FIG. 1 is a schematic system configuration view of a display device according to an embodiment of the present invention.

Hereinafter, embodiments of the present invention will be described with reference to the accompanying drawings. In designating elements of the drawings by reference numerals, the same elements will be designated by the same reference numerals although they are shown in different drawings. Further, in the following description of the present invention, a detailed description of known functions and configurations incorporated herein will be omitted when it may make the subject matter of the present invention rather unclear.

In addition, terms, such as first, second, A, B, (a), (b) or the like may be used herein when describing components of the present invention. Each of these terminologies is not used to define an essence, order or sequence of a corresponding component but used merely to distinguish the corresponding component from other component(s). In the situation that it is described that a certain structural element "is connected to," "is coupled to," or "is in contact with" another structural element, it should be interpreted that another structural element may "be connected to," "be coupled to," or "be in contact with" the structural elements as well as that the certain structural element is directly connected to or is in direct contact with another structural element.

FIG. 1 is a schematic system configuration view of a display device 100 according to an embodiment.

Referring to FIG. 1, the display device 100 according to an embodiment includes a display panel 110, a data driving unit 120, a gate driving unit 130, a timing controller 140 and the like.

In the display panel 110, data lines DL1, DL2, . . . , and DLm and gate lines GL1, GL2, . . . , and GLn are formed, and a SubPixel (SP) is formed in every point where the data lines DL1, DL2, . . . , and DLm and the gate lines GL1, GL2, . . . , and GLn intersect.

The data driving unit 120 provides a data voltage to the data lines. The data driving unit 120 includes two or more Data driving Integrated Circuits (DICs) 200.

The gate driving unit 130 sequentially provides a scan signal to the gate lines. The timing controller 140 controls the data driving unit 120 and the gate driving unit 130.

In an example, in the subpixel formed in the display panel 110, a circuit including at least one transistor is configured.

Here, the circuit in the subpixel may further include at least one capacitor and Organic Light Emitting Diode (OLED) according to a circuit design method, a display device type, and the like, in addition to at least one transistor.

The display device 100 according to an embodiment may provide a pixel compensation function. The pixel compensation function is for compensating a luminance deviation between the subpixels, which is generated according to a change or a deviation of a characteristic (e.g., a threshold voltage, mobility and the like) of the transistor in the circuit of the subpixel.

The display device 100 according to the embodiment includes a configuration for sensing the characteristic value of the transistor in the circuit of the subpixel in order to provide the pixel compensation function.

Thus, in the display panel 110, a Sensing Line (SL) connected to the circuit in the subpixel may be formed in every one or more sub pixel rows.

For example, in a situation of a shared structure in which one sensing line exists every two or more subpixel rows, one sensing line may exist in every three subpixel rows (e.g., a red subpixel row, a green subpixel row and a blue subpixel row).

That is, when one pixel includes three subpixels (i.e., a red subpixel, a green subpixel and a blue subpixel), one sensing line may exist in every pixel row.

Alternatively, one sensing line may exist every four subpixel rows (e.g., a red subpixel row, a white subpixel row, a green subpixel row and a blue subpixel row). That is, when one pixel includes four subpixels (i.e., a red subpixel, a white subpixel, a green subpixel and a blue subpixel), one sensing line may exist in every pixel row.

For example, in order to provide the pixel compensation function, the display device 100 according to an embodiment may further include a sensing unit and a pixel compensation unit in addition to the sensing line. The sensing unit converts a sensing analog voltage Vsen measured through each sensing line SL into a sensing digital data Desn. The pixel compensation unit changes data provided to the subpixel based on the sensing data which is sensed by the sensing unit and is output from the sensing unit, to compensate a pixel.

Hereinafter, the above-mentioned sensing unit is referred to as an Analog to Digital Converter (ADC).

The ADC may be placed in any position of the display device 100, but the ADC is included in the data driving integrated circuit as an embodiment in the present specification and drawings.

In addition, the above-mentioned pixel compensation unit may be placed in any position of the display device 100, but the pixel compensation unit is included in the timing controller 140 as an embodiment in the present specification and drawings.

Figure 2:
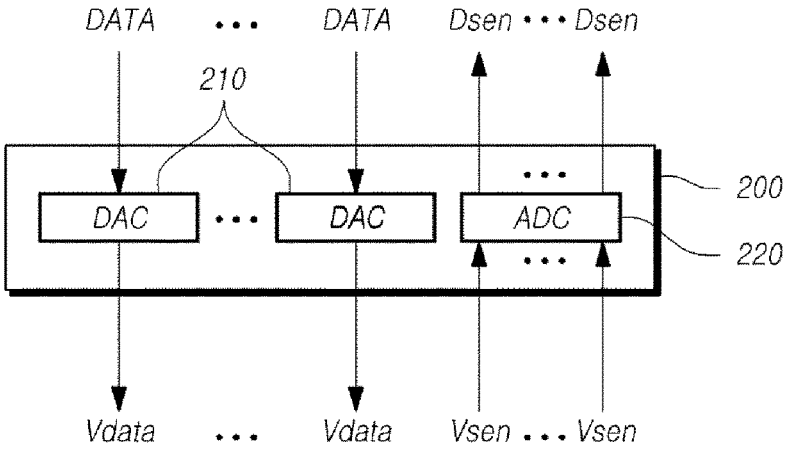
FIG. 2 is a view schematically illustrating a data driving integrated circuit of a data driving unit in the display device according to an embodiment of the present invention.

FIG. 2 is a view schematically illustrating the data driving integrated circuit 200 of the data driving unit 120 in the display device 100 according to an embodiment.

Referring to FIG. 2, each data driving circuit 200 includes a driving configuration for providing an analog voltage data Vdata to a plurality of corresponding subpixels, and a sensing configuration for the plurality of corresponding subpixels.

Referring to FIG. 2, the driving configuration includes a Digital to Analog Converter (DAC) 210 which converts digital data (Data) input from the timing controller 140 to the analog voltage data (Vdata).

Referring to FIG. 2, the sensing configuration may include an ADC 200. The ADC 200 senses the voltage Vsen of a sensing node in the circuit of the plurality of corresponding subpixels through two or more sensing lines (of which concept may be equal to that of sensing channels), converts the analog voltage Vsen to the sensing digital data Dsen, and outputs the sensing data Dsen.

As shown in FIG. 2, one ADC 200 is included in one data driving integrated circuit 200. Thus, if two or more data driving integrated circuits 200 are in the display device 100, two or more ADCs 200 are also included in the display device 100.

One ADC 220 included in one data driving integrated circuit 200 is connected to two or more sensing lines SL, and senses the voltage Vsen through each sensing line.

In this example, one sensing line GL connects the ADC 200 with one or more subpixel rows. That is, each of two or more sensing lines connected to one ADC 220 may be a line sensing the voltage of the sensing node of the circuit in one subpixel, but in a shared structure configuration, each of two or more sensing lines connected to one ADC 220 may be a line simultaneously or sequentially sensing the voltage of the sensing node of the circuit in two or more subpixels.

The ADC 200 included in one data driving integrated circuit 200 converts the sensing voltage Vsen which is measured through sensing channels respectively corresponding to two or more sensing lines into the sensing data Vsen of a digital type.

Figure 3:
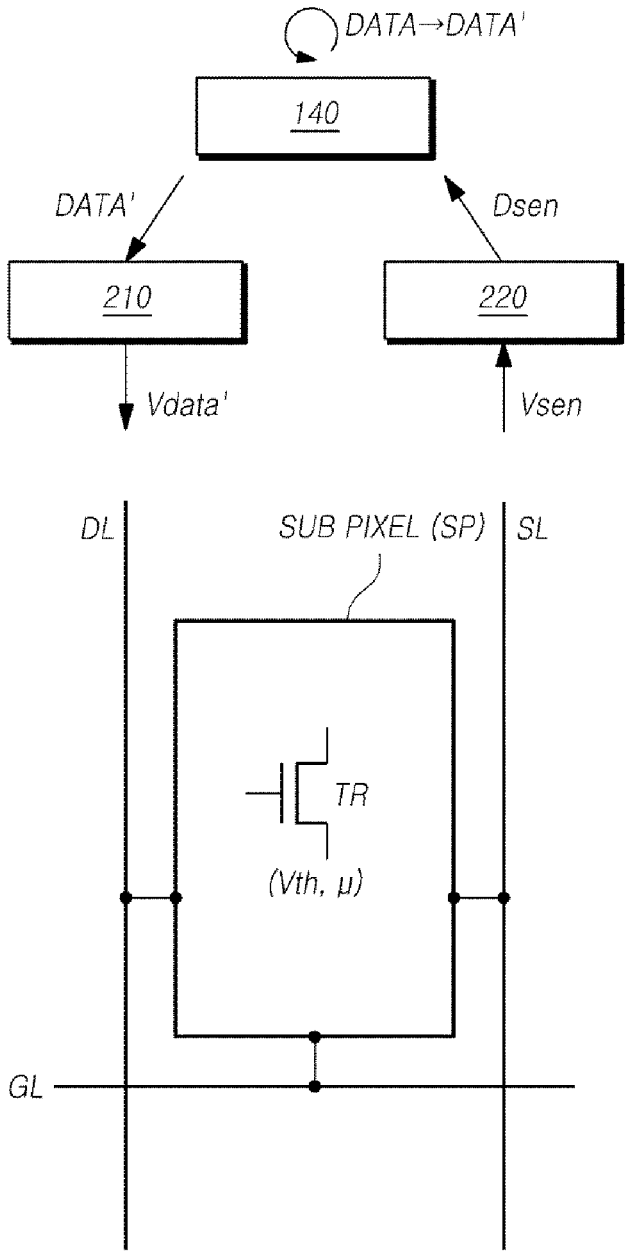
FIGS. 3 and 4 are conceptual diagrams illustrating a pixel compensation of the display device according to an embodiment of the present invention.

FIG. 3 is a conceptual diagram illustrating a pixel compensation of the display device 100 according to an embodiment.

Referring to FIG. 3, the ADC 220 in the data driving integrated circuit 200 senses the voltage Vsen of the sensing node (e.g., a source or drain node of the transistor) in a circuit of the subpixel SP through the sensing line SL connected to the circuit in the subpixel SP, converts the analog voltage Vsen into the sensing digital data Dsen, and outputs the sensing data Dsen.

The timing controller 140 changes the data (Data) provided to a corresponding subpixel SP and outputs the changed data (Data'), in order to compensate a characteristic value (e.g., a threshold voltage (Vth), a mobility (μ) and the like) of the transistor TR in the subpixel SP, using the sensing data Dsen. Thus, the DAC 210 in the data driving integrated circuit 220 converts the changed data (Data') into an analog data voltage (Vdata') and outputs the analog data voltage Vdata' to the subpixel SP.

Therefore, the corresponding pixel SP receives the analog data voltage Vdata' for compensating the characteristic value of the transistor TR, and a luminance non-uniformity of the corresponding subpixel SP may be prevented or reduced.

The pixel compensation schematically described in FIG. 3 is described in more detail with reference to FIGS. 4 and 5.

Figure 4:
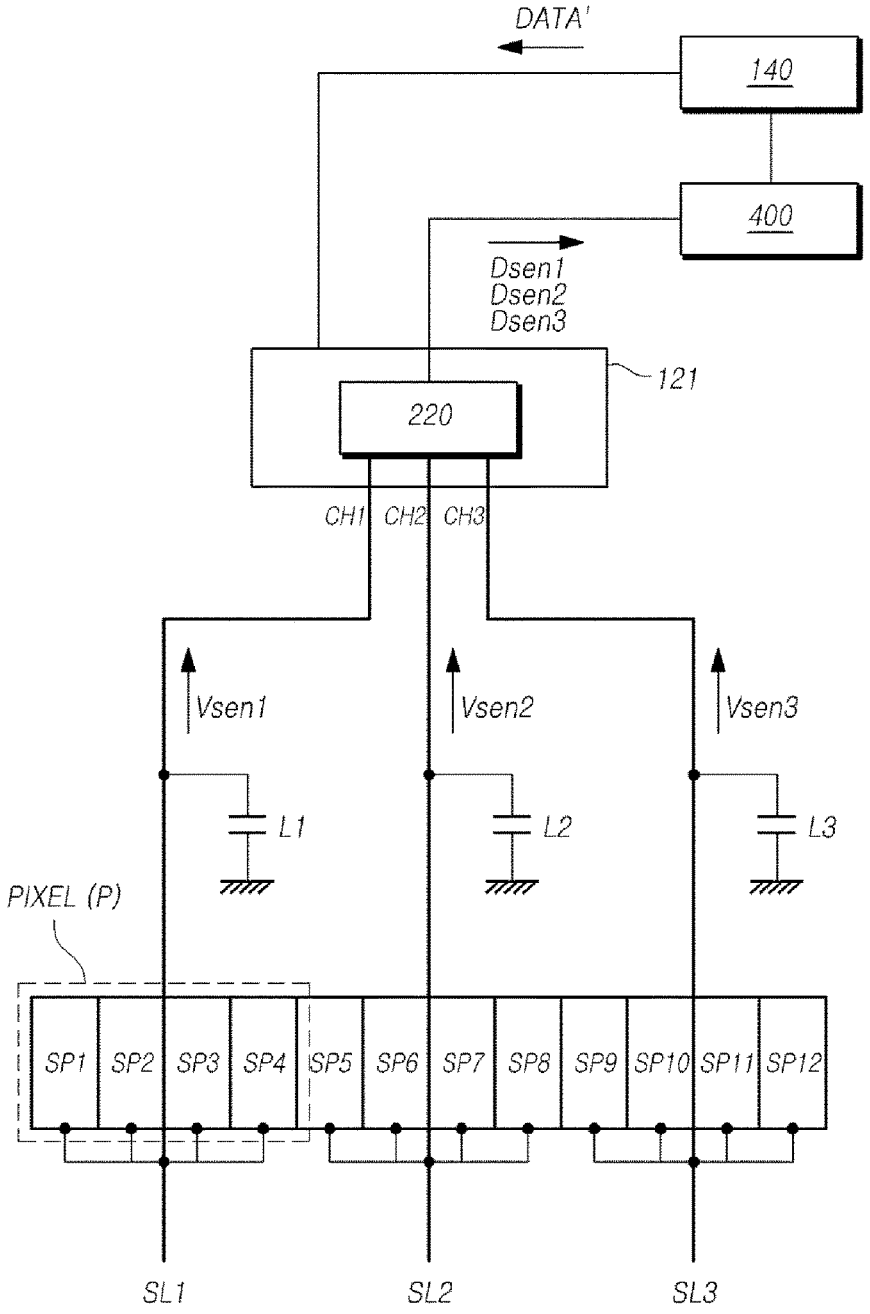

FIG. 4 is a view illustrating a pixel compensation of the display device 100 according to an embodiment. FIG. 5 is a conceptual diagram illustrating sensing and converting functions of the ADC 200 in the display device 100 according to an embodiment.

In the example shown in FIG. 4, one ADC 220 has three sensing channels CH1, CH2 and CH3. The three sensing channels CH1, CH2 and CH3 are connected to three sensing lines SL1, SL2 and SL3, respectively. Each of three sensing lines SL1, SL2 and SL3 is connected to four subpixels SP. The four subpixels SP may form one pixel P. For example, the four subpixels SP may include a red subpixel, a white subpixel, a green subpixel and a blue subpixel.

Referring to FIG. 4, the ADC 220 may sense the voltage Vsen of the sensing node in one subpixel SP, through each sensing line SL1, SL2 and SL3 at one time.

Figure 5:
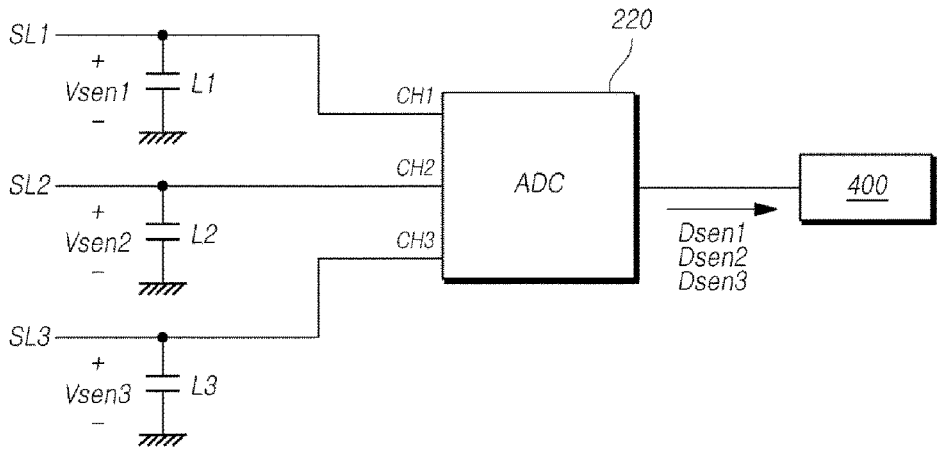
FIG. 5 is a conceptual diagram illustrating sensing and converting functions of an ADC in the display device according to an embodiment of the present invention.

Referring to FIGS. 4 and 5, the three sensing lines SL1, SL2 and SL3 are connected to latches L1, L2 and L3, respectively. The latches L1, L2 and L3 store the sensing voltage Vsen of the sensing node in a corresponding subpixel. The above-mentioned latches L1, L2 and L3 may be implemented as a capacitors as shown in FIG. 4.

Referring to FIGS. 4 and 5, the ADC 220 converts voltages Vsen1, Vsen2 and Vsen3 sensed through the three sensing channels CH1, CH2 and CH3 into a digital type, and outputs converted sensing data Dsen1, Dsen2 and Dsen3 to store in a memory 400.

Referring to FIG. 4, as described above, the timing controller 140 reads all pieces of sensing data Dsen1, Dsen2, Dsen3, . . . which are sensed by the ADC 220 and stored in the memory 400, changes the data (Data) provided to the subpixel, and outputs the changed data (Data') to the data driving integrated circuit 200.

Thus, the data driving integrated circuit 200 receives the changed data (Data'), converts the changed data Data' into the data voltage Vdata' of the analog type, and provides the data voltage Vdata' to a corresponding subpixel through an output buffer.

In addition, the timing controller 140 may control the pixel compensation which compensates the threshold voltage (Vth) of the transistor in each subpixel when a power off signal of the display device 100 is generated.

Here, when the power off signal of the display device 100 is generated, the pixel compensation for compensating the threshold voltage of the transistor in each subpixel is referred to an OFF Real time Sensing (hereinafter, referred to as an OFF-RS).

In addition, when the power of the display device 100 is turned on, a pixel compensation for compensating the mobility (p) of the transistor in the subpixel may also be performed in real time.

For example, the pixel compensation for compensating the mobility (p) of the transistor in each subpixel in real time when the power of the display device 100 is turned on is referred to as a Real Time (hereinafter, referred to as an RT) compensation. For the above-mentioned RT compensation, the timing controller 140 may control the pixel compensation (i.e., the RT compensation) which compensates the mobility (p) of the transistor in each subpixel during a blank time on a vertical synchronous signal.

Figure 6:
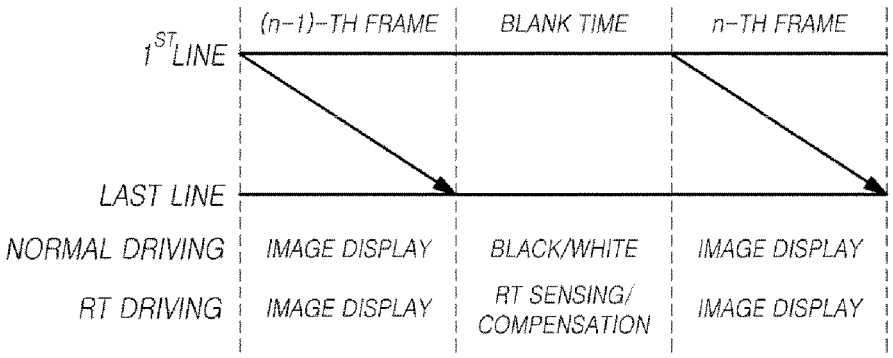
FIG. 6 is a view illustrating a normal driving and an RT compensation of an organic light emitting diode display device according to an embodiment of the present invention.
Figure 7:
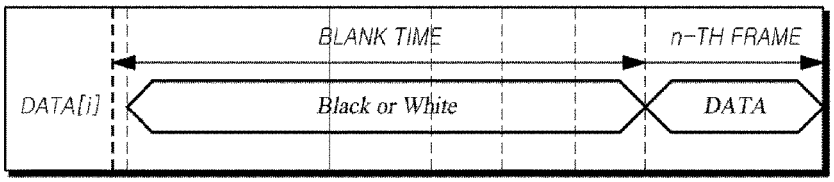
FIG. 7 illustrates data input during a blank time and an n-th display frame for the normal driving according to an embodiment of the present invention.
Figure 8:
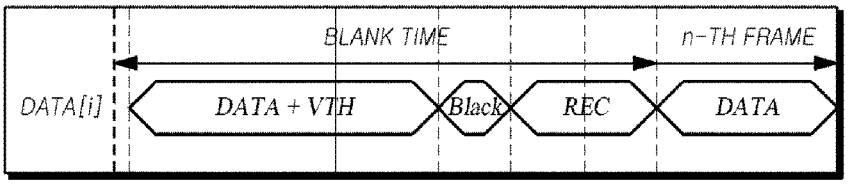
FIG. 8 illustrates data input during a blank time and an n-th display frame for the RT compensation according to an embodiment of the present invention.

FIG. 6 is a view illustrating normal display driving and an RT compensation of an organic light emitting diode display device. FIG. 7 illustrates data input during a blank time and an n-th display frame for normal driving. FIG. 8 illustrates data input during a blank time and an n-th display frame for the RT compensation.

Referring to FIGS. 6 and 7, while in normal driving in which an image is displayed, data voltage Vdata is provided to first through last data lines during a time of an (n−1)-th frame and an n-th frame, and thus an image is displayed.

Referring to FIGS. 6 and 8, when performing the RT compensation, a sensing signal is provided to one or more lines (e.g., m lines) among all lines during a blank time between the (n−1)-th frame and the n-th frame, and thus a real time sensing is performed. At this time, as shown in FIG. 8, the sensing signal may be DATA+VTH compensating the threshold voltage of the transistor in each subpixel, which is sensed when the power off signal of the display device 100 is generated.

All subpixels or some subpixels in which the sensing is performed are selectively switched to detect the sensing voltage Vsen. Next, the detected sensing voltage Vsen is converted into compensation data (ΔData), which corresponds to the mobility of a driving transistor DRT in each subpixel SP.

In a similar manner, during the blank time in a plurality of frames, the mobility of the driving transistor DRT in subpixels is detected, and the data voltage Vdata applied to the subpixel is compensated for using the compensation data ΔData based on the detected threshold voltage and the mobility. Specially, as shown in FIG. 8, after the mobility of the driving transistor DRT in each of the subpixels of the display panel 110 is detected during the blank time of the plurality of frames, a recovery data REC is applied to the driving transistor DRT of the subpixels to reset the driving transistor DRT in each of the subpixels to which the sensing signal is applied to detect the mobility during the blank time, just before the next frame.

Figure 9:
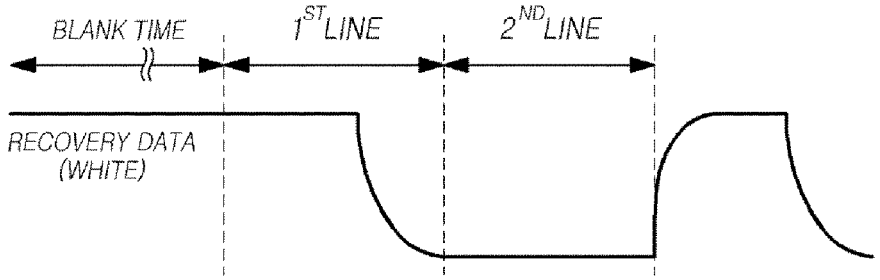
FIG. 9 illustrates data driving using a one by one pattern according to an embodiment of the present invention.
Figure 10:
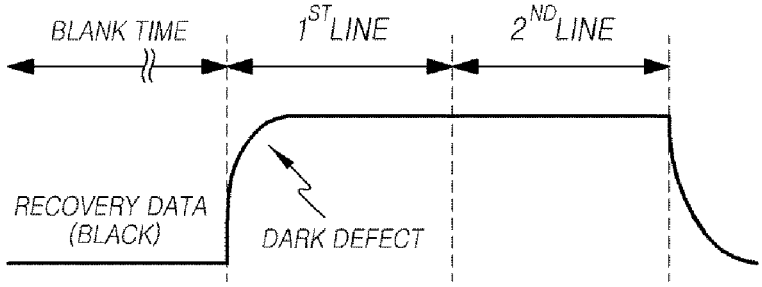
FIG. 10 illustrates data driving using a W solid pattern according to an embodiment of the present invention.

FIG. 9 illustrates data driving having a one by one pattern. FIG. 10 illustrates data driving of a W solid pattern.

For example, when using the normal driving, and a data voltage of black is applied to the pixel, a dark defect for a first gate line of the n-th display frame may be generated. As described later with reference to FIG. 10, the dark defect of FIG. 9 is equal to a dark defect of the first gate line of the n-th frame when the data voltage of the black is applied to the pixel in the situation of the RT compensation.

When performing the RT compensation, the recovery data REC may influence the charge of the first gate line of the next display frame. Therefore, a charge characteristic of the first gate line of the n-th frame may be changed based on what type of recovery data REC is used. Especially, as shown in FIG. 9, in the one by one pattern in which a high and a low repeat, the recovery data REC is not regular and swings. Thus, a vibration defect may be generated for the first gate line of the n-th frame. As shown in FIG. 10, even when using the W solid pattern in which data voltages of two gate lines are regular, since the recovery data REC is not regular and swings, a vibration defect for the first gate line of the n-th frame may also be generated.

As shown in FIGS. 9 and 10, the data voltage of black or white is applied to the pixel as the recovery data REC in a specific pattern, and when black is used as the recovery data REC, a dark defect of the first gate line is generated as shown in FIG. 10, and when white is sued as the recovery data REC, a brightness defect of the first gate line is generated as shown in FIG. 9.

Figure 11:
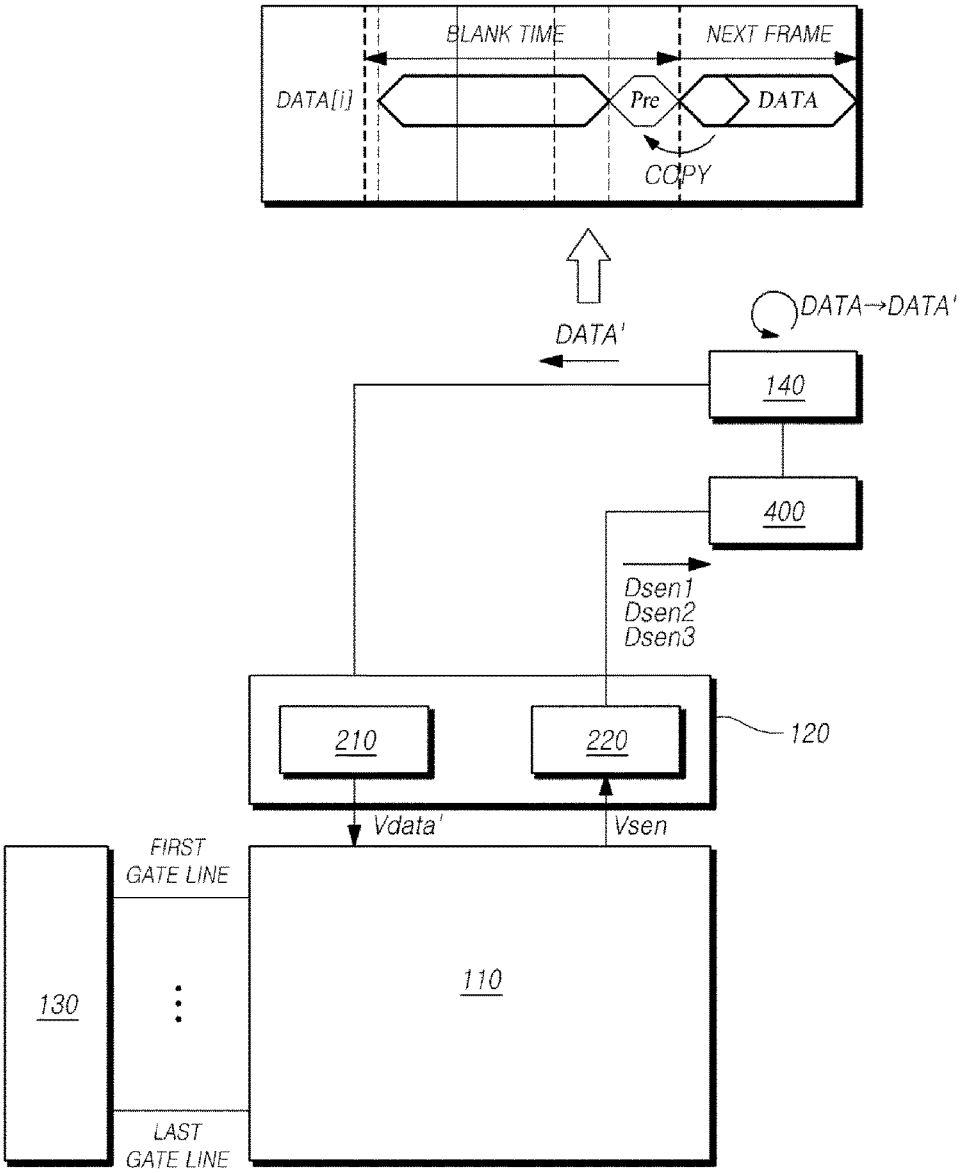
FIG. 11 is a configuration diagram of the display device according to an embodiment of the present invention.

FIG. 11 is a configuration diagram of the display device according to an embodiment.

Referring to FIG. 11, the display device according to an embodiment includes a display panel 110, a gate driving unit 120, a data driving unit and a timing controller 140. The display panel 110 includes gate lines and data lines. A subpixel including a transistor in every point where data lines and gate lines intersect is disposed in the display panel 110. The gate driving unit 130 sequentially provides a gate signal to the gate lines. The data driving unit 120 provides a data voltage to the data lines according to the gate signal provided to each gate line. The timing controller 140 controls the gate driving unit and the data driving unit, and performs a pixel compensation which changes data that is provided to each subpixel.

Before a specific display frame, during a blank time, the data driving unit 120 may output, to the data lines, data voltages having an output waveform that is identical to the data voltages of at least one gate line during the specific display frame. In other words, the data voltages of at least one gate line for a specific display frame can be copied and pre-supplied to the date lines just before the actual display of that specific frame. For example, the timing controller 140 copies data corresponding to the data voltages of at least one gate line from a specific frame to output during the blank time, such that the data driving unit 120 outputs, to the data lines, the data voltages having a waveform that is identical to that of the data voltages of at least one gate line from the specific frame.

The output of the data voltages of which the output waveform is identical to that of the data voltages of at least one gate line, to the data lines may be performed just before data voltages of a first gate line of a specific frame (hereinafter, referred to as an n-th frame) are output during the blank time. Thus, the data driving unit 120 may output, to the data lines during the blank time, the data voltages of which the output waveform is identical to that of the data voltages of at least one gate line just before the data voltages of the first gate line are output for a display frame.

In addition, the pixel compensation may be the RT compensation which compensates the mobility of the transistor in each subpixel during the blank time on the vertical synchronous signal (Vsync). The timing controller 140 may control the real time sensing to be performed, which senses the mobility of the transistor in each subpixel during the blank time on the vertical synchronous signal (Vsync).

The blank time may be a blank time when the RT compensation is performed. That is, the data driving unit 120 may output, to the data lines, the data voltages of which the output waveform is identical to that of the data voltages of at least one gate line of a next display frame during the blank time when the real time sensing is performed.

Figure 12:
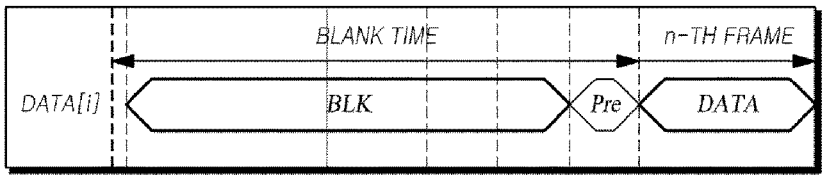
FIG. 12 illustrates outputting data voltages to the data lines, during a blank time for normal driving, which have a waveform that is identical to the data voltages for at least one gate line during a display frame according to an embodiment of the present invention.
Figure 13:
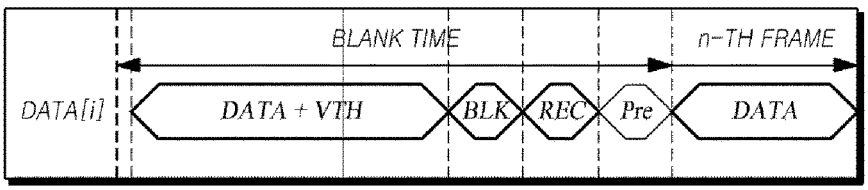
FIG. 13 illustrates outputting data voltages to the data lines, during a blank time for the Real Time (RT) compensation, which have a waveform that is identical to the data voltages for at least one gate line of a display frame according to an embodiment of the present invention.

FIG. 12 illustrates the outputting of the data voltages having a waveform that is identical to that of the data voltages of at least one gate line for an n-th frame, to the data lines, during the blank time of normal driving. FIG. 13 illustrates the outputting of the data voltages of which the output waveform is identical to that of the data voltages of at least one gate line, to the data lines, during the blank time for the RT compensation.

Referring to FIG. 12, an example of normal driving is shown in which data voltages having a waveform that is identical to that of the data voltages of at least one gate line may be output to the data lines during the blank time. Thus, the data driving unit 120 may output, to the data lines during the blank time, the data voltages of which the output waveform is identical to that of the data voltages of at least one gate line of a display frame when performing normal driving.

Since the data voltages have a waveform that is identical to that of the data voltages of at least one gate line of a display frame are output to the data lines during the blank time of normal driving, the dark defect of the first gate line of the n-th frame may be prevented when the data voltage of black is applied to the pixel.

Referring to FIG. 13, the data voltages of which the output waveform is identical to that of the data voltages of at least one gate line may be output to the data lines during the blank time in the situation of the RT compensation. Thus, the data driving unit 120 may output, to the data lines, the data voltages of which the output waveform is identical to that of the data voltages of at least one gate line during the blank time in the situation of the RT compensation.

Since the data voltages output during the blank time are identical to that of the data voltages of at least one gate line that are output to the data lines during a display frame for the RT compensation, the dark defect and the brightness defect of the first gate line of the n-th frame may be prevented when the data voltage of the black is applied to the pixel.

Specifically, when the first gate line is driven for the n-th frame after a driving of the last gate line of the (n−1)-th frame and after the blank time, the change in the data voltage or the size of the data voltage may influence the charge characteristic of the first gate line of the n-th frame. Therefore, the data voltage and the voltage of the source node of the driving transistor DTR may be expected by using the data voltage of at least one gate line to drive the first gate line of the n-th frame after the blank time, in order to prevent a charge rate change due to the data voltage Vdata and the voltage of the source node of the driving transistor DRT. The data voltage or the voltage change which may influence the charge characteristic of the first gate line of the n-th frame to be initialized such that the charge characteristic of the first gate line of the n-th frame is equal to the charge characteristic of the gate line of the n-th frame by comparing the data voltage Vdata of the first gate line of the n-th frame with the data voltage Vdata of the second gate line of the n-th frame.

Figure 14:
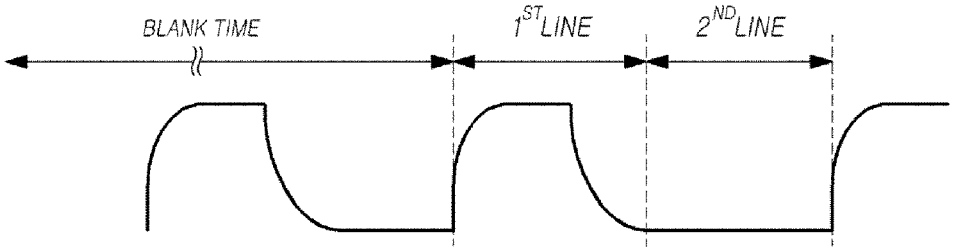
FIG. 14 illustrates outputting data voltages to the data lines during the blank time, which have an output waveform (e.g., one by one pattern) that is identical to that of the data voltages of first and second gate lines of a specific display frame according to an embodiment of the present invention.
Figure 15:
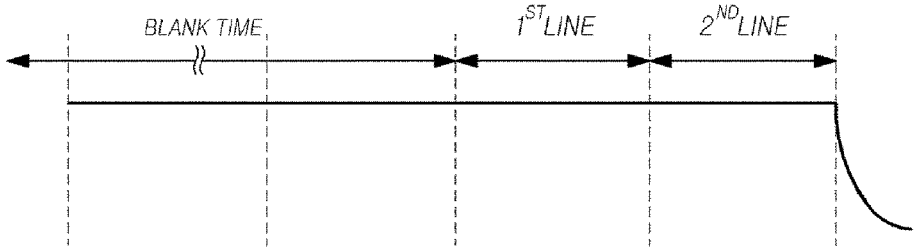
FIG. 15 illustrates the outputting of the data voltages to the data lines during the blank time, which have an output waveform (e.g., W solid pattern) that is identical to that of the data voltages of first and second gate lines for a specific display frame according to an embodiment of the present invention.

FIG. 14 illustrates outputting data voltages having an output waveform (e.g., one by one pattern) that is identical to that of data voltages of the first and second gate lines of the specific frame (e.g., the next display frame) to the data lines during the blank time. FIG. 15 illustrates the outputting of the data voltages having an output waveform (e.g., W solid pattern) that is identical to that of the data voltages of the first and second gate lines of the specific frame to the data lines during the blank time.

Referring to FIGS. 14 and 15, the data voltages of at least one gate line of the n-th frame may be the same as the data voltages of the first and second gate lines of the next frame. Thus, the data driving unit 120 may sequentially output, to the data lines, the data voltages of which the output waveform is identical to that of the data voltages of the first and second gate lines during the blank time.

For example, during the blank time, the output waveform of the data voltages may be any among the one by one pattern shown in FIG. 14, the W solid pattern shown in FIG. 15, and the like.

The sequential output waveform is copied just before the data voltage Vdata of the first gate line is output during the blank time to output the sequential output waveform. Therefore, the charge characteristic of the first gate line is equal to charge characteristics of second to last gate lines according to each pattern since a charge environment according to such a pattern is similar. Thus, a luminance difference recognition level of the first gate line may be reduced.

Figure 16:
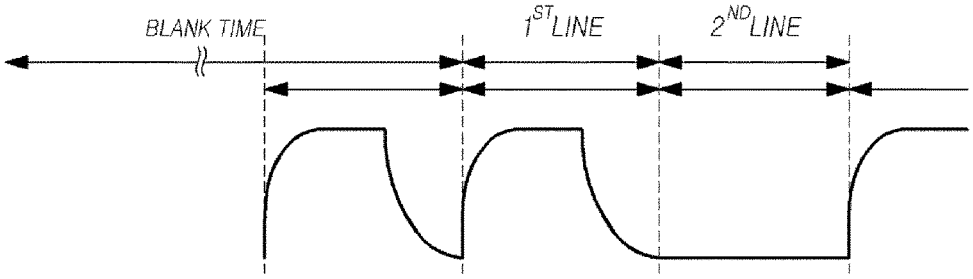
FIG. 16 illustrates outputting data voltages to the data lines during the blank time, which have an output waveform that is identical to that of the data voltages of the first gate line of a specific display frame according to an embodiment of the present invention.

FIG. 16 illustrates the outputting of the data voltages, during the blank time, of which the output waveform (e.g., one by one pattern) is identical to that of the data voltages of the first gate line of the specific frame.

Referring to FIG. 16, the data voltages of at least one gate line of the n-th frame may be data voltages of the first gate line of the next frame. Thus, the data driving unit 120 may sequentially output, to the data lines during the blank time, data voltages having a waveform identical to that of the data voltages of the first gate line.

For example, the output waveform of the data voltages may be any among the one by one pattern shown in FIG. 16, and the above-mentioned W solid pattern, and the like.

According to the above-mentioned embodiment, a charge characteristic environment may be equalized using a characteristic of the output waveform of the data voltage of the first gate line of the specific frame and the output waveform of the data voltage of the blank time.

According to the above-mentioned embodiment, a sequential output waveform of the data voltage of at least one gate line, for example the first gate line and/or the second gate line of the specific frame is copied just before the data voltage of the first gate line is output for the next frame, to output the sequential output waveform during the blank time. Therefore, the charge characteristic of the first gate line is equal to the charge characteristics of the second to last gate lines according to each pattern, and thus the charge environment according to the pattern may be similar.

In order to provide a simplified implementation, data corresponding to the data voltages of the first gate line of the specific frame and/or data corresponding to the data voltages of the second gate line of the specific frame may be used as pre-data during the blank time, by copying the data corresponding to the data voltages of the first gate line of the specific frame and/or the data corresponding to the data voltages of the second gate line of the specific frame.

According to the above-mentioned embodiment, the pixel compensation function may be provided, and the dark or brightness defect of the first gate line of the specific frame may be prevented.

In the above, the present invention is described with reference to drawings, but the present invention is not limited thereto. That is, the charge characteristic environment is equalized using the characteristic of the output waveform of the data voltages of the first gate line of the specific frame and the output waveform of the data voltage of the blank time, but the present invention is not limited thereto.

Figure 17:
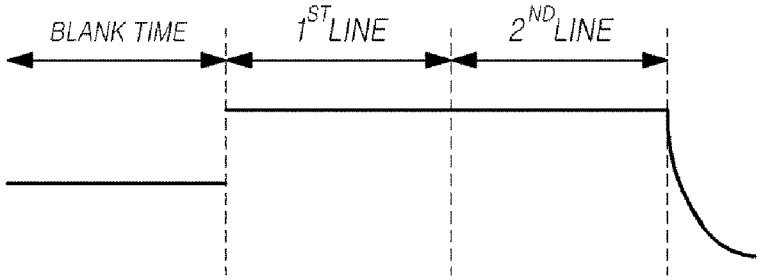
FIG. 17 illustrates outputting a data voltage of a predetermined level during a predetermined time period within the blank time just before the data voltage of the first gate line is output for a specific display frame according to an embodiment of the present invention.

That is, in order to simplify an implementation, a data voltage of a predetermined level is output as shown in FIG. 17 during a predetermined time in the blank time, just before the data voltage of the first gate line is output for the display frame, and thus the charge characteristic environment may be expected. At this time, the output waveform of the data voltages may be any among the one by one pattern, the W solid pattern shown in FIG. 17, and the like. The elements are equal to those of the display device 100 described with reference to FIG. 11, except for the outputting of the data voltages of the predetermined level during the blank time as shown in FIG. 17.

A product in which the display device according to the present embodiments is used refers to electronics including the display device 100 such as a television, a television system, a home theater system, a set-top box, a navigation system, a DVD player, a Blu-ray player, a Personal Computer (PC), a phone system, a notebook computer, a monitor, and the like.

The above description and the accompanying drawings provide examples of the technical idea of the present invention for illustrative purposes only. Those having ordinary knowledge in the technical field, to which the present invention pertains, will appreciate that various modifications and changes in form, such as combination, separation, substitution, and change of a configuration, are possible without departing from the essential features of the present invention. Accordingly, the embodiments disclosed in the present invention are merely to not limit but describe the technical spirit of the present invention. Further, the scope of the technical spirit of the present invention is limited by the embodiments. The scope of the present invention shall be construed on the basis of the accompanying claims so all of the technical ideas included within the scope equivalent to the claims belong to the present invention.

What is claimed is:

1. A display device comprising:

a display panel including data lines, gate lines and subpixels, each subpixel including a transistor where one of the data lines intersects one of the gate lines;

a gate driving unit configured to sequentially output a gate signal to the gate lines;

a data driving unit configured to:

output display data voltages to the data lines according to the gate signal provided to each of the gate lines for displaying an image during an image display frame period, and output pre-display data voltages to the data lines during a blank time period before the image display frame period, wherein the pre-display data voltages have output waveforms that are identical to waveforms of the display data voltages on the data lines that correspond to at least one gate signal provided to one of the gate lines during the image display frame period; and a timing controller configured to control the gate driving unit and the data driving unit, and perform pixel compensation by changing display data provided to at least one subpixel among the subpixels for displaying the image during the image display frame period.

2. The display device of claim 1, wherein the data driving unit outputs the pre-display data voltages to the data lines during the blank time period, immediately before the display data voltages for subpixels corresponding to a first gate line are output on the data lines during the image display frame period.

3. The display device of claim 1, wherein the timing controller senses a voltage of the transistor in each subpixel during the blank time period on a vertical synchronous signal (Vsync) for compensating a mobility of the transistor.

4. The display device of claim 1, wherein a first row of subpixels corresponding to a first gate line are supplied with the pre-display data voltages on the data lines during the blank time period that have output waveforms that are identical to waveforms corresponding to display data voltages supplied to the first row of subpixels for displaying the image during the image display frame period.

5. The display device of claim 1, wherein the pre-display data voltages have output waveforms that are identical to waveforms of the display data voltages on the data lines that correspond to at least two gate signals provided to two of the gate lines during the image display frame period.

6. The display device of claim 1, wherein the output waveforms are a one by one pattern in which a positive voltage and a negative voltage are supplied in turns at each gate line or a W solid pattern in which a positive voltage and a negative voltage are supplied in turns at every two gate lines.

7. The display device of claim 1, wherein the data driving unit outputs the pre-display data voltages to the data lines during the blank time period when real time (RT) sensing is performed for compensating a mobility of the transistor.

8. The display device of claim 1, wherein the blank time period includes a black period and a pre-data period before the image display frame period when performing normal driving, and wherein data voltages corresponding to black color are supplied to the data lines during the black period and the pre-display data voltages are supplied to the data lines during the pre-data period.

9. The display device of claim 1, wherein the blank time period includes a sensing signal period followed by a black period, a recovery period and a pre-data period before the image display frame period when performing real time compensation for the at least one subpixel, and wherein the pre-display data voltages are supplied to the data lines during the pre-data period.

10. A display device comprising:

a display panel including data lines, gate lines and subpixels, each subpixel including a transistor where one of the data lines intersects one of the gate lines;

a gate driving unit configured to sequentially output a gate signal to the gate lines;

a data driving unit configured to:

output display data voltages to the data lines according to the gate signal provided to each of the gate lines for displaying an image during an image display frame period, and output pre-display data voltages to the data lines during a blank time period before the image display frame period, wherein the pre-display data voltages each have a pre-determined voltage level based on a corresponding waveform among waveforms of the display data voltages on the data lines that correspond to at least one gate signal provided to one of the gate lines during the image display frame period; and a timing controller configured to control the gate driving unit and the data driving unit, and perform pixel compensation by changing display data provided to at least one subpixel among the subpixels for displaying the image during the image display frame period.

11. The display device of claim 10, wherein the data driving unit outputs the pre-display data voltages to the data lines during the blank time period, immediately before the display data voltages for subpixels corresponding to a first gate line are output on the data lines during the image display frame period, and wherein the pre-display data voltages have output waveforms that are identical to waveforms of the display data voltages on the data lines that correspond to at least one gate signal provided to one of the gate lines during the image display frame period.

12. The display device of claim 10, wherein the timing controller senses a voltage of the transistor in each subpixel during the blank time period on a vertical synchronous signal (Vsync) for compensating a mobility of the transistor.

13. The display device of claim 10, wherein a first row of subpixels corresponding to a first gate line are supplied with the pre-display data voltages on the data lines during the blank time period that have output waveforms that are identical to waveforms corresponding to display data voltages supplied to the first row of subpixels for displaying an image the during the image display frame period.

14. The display device of claim 10, wherein the pre-display data voltages have output waveforms that are identical to waveforms of the display data voltages on the data lines that correspond to at least two gate signals provided to two of the gate lines during the image display frame period.

15. The display device of claim 10, wherein output waveforms of the pre-display data voltages are a one by one pattern in which a positive voltage and a negative voltage are supplied in turns at each gate line or a W solid pattern in which a positive voltage and a negative voltage are supplied in turns at every two gate lines.

16. The display device of claim 10, wherein the data driving unit outputs the pre-display data voltages to the data lines during the blank time period when real time (RT) sensing is performed for compensating a mobility of the transistor.

17. The display device of claim 13, wherein the pre-display data voltages have output waveforms that are identical to waveforms of the display data voltages on the data lines that correspond to at least one gate signal provided to one of the gate lines during the image display frame period.

18. The display device of claim 10, wherein the blank time period includes a black period and a pre-data period before the image display frame period when performing normal driving, and wherein data voltages corresponding to black color are supplied to the data lines during the black period and the pre-display data voltages are supplied to the data lines during the pre-data period.

19. The display device of claim 10, wherein the blank time period includes a sensing signal period followed by a black period, a recovery period and a pre-data period before the image display frame period when performing real time compensation for the at least one subpixel, and wherein the pre-display data voltages are supplied to the data lines during the pre-data period.

* * * * *